US009347363B2

(12) United States Patent
Barnes

(10) Patent No.: US 9,347,363 B2
(45) Date of Patent: May 24, 2016

(54) FLUID PUMP ASSEMBLY

(71) Applicant: Cummins IP, Inc., Minneapolis, MN (US)

(72) Inventor: David M. Barnes, Columbus, IN (US)

(73) Assignee: CUMMINS IP, INC., Minneapolis, MN (US)

( * ) Notice: Subject to any disclaimer, the term of this patent is extended or adjusted under 35 U.S.C. 154(b) by 418 days.

(21) Appl. No.: 13/767,673

(22) Filed: Feb. 14, 2013

(65) Prior Publication Data

US 2014/0224194 A1 Aug. 14, 2014

(51) Int. Cl.

| | |
|---|---|
| ***F01P 5/10*** | (2006.01) |
| ***F01P 5/04*** | (2006.01) |
| *F01P 5/12* | (2006.01) |
| *F01P 7/16* | (2006.01) |
| *F02B 75/22* | (2006.01) |

(52) U.S. Cl.

CPC ... *F01P 5/04* (2013.01); *F01P 5/10* (2013.01); *F01P 5/12* (2013.01); *F01P 7/164* (2013.01); *F01P 2005/125* (2013.01); *F02B 75/22* (2013.01)

(58) Field of Classification Search

CPC ..... F01P 5/10; F01P 5/12; F01P 7/164; F01P 2005/125; F02B 75/22

USPC ..... 123/41.44

See application file for complete search history.

(56) References Cited

U.S. PATENT DOCUMENTS

| | | | | |
|---|---|---|---|---|
| 3,792,697 | A | 2/1974 | Walter et al. | |
| 5,111,774 | A | 5/1992 | Hiramoto et al. | |
| 5,191,859 | A | 3/1993 | Fujiwara | |
| 5,279,265 | A | 1/1994 | Matsuo et al. | |
| 5,355,847 | A | 10/1994 | Ozeki | |
| 5,540,192 | A | 7/1996 | Xanders | |
| 6,112,706 | A | 9/2000 | Heer | |
| 6,200,089 | B1 | 3/2001 | Heer | |
| 6,244,239 | B1 | 6/2001 | Sisco et al. | |
| 6,408,803 | B1 * | 6/2002 | Atkins | 123/41.81 |
| 6,453,868 | B1 | 9/2002 | McClure | |
| 6,960,066 | B2 | 11/2005 | Koga et al. | |
| 7,878,757 | B2 | 2/2011 | Therrien et al. | |
| 8,011,899 | B2 | 9/2011 | Crider | |
| 2007/0103002 | A1 * | 5/2007 | Chiao et al. | 307/10.1 |

FOREIGN PATENT DOCUMENTS

| | | |
|---|---|---|
| AT | 1411506 | 10/1975 |
| EP | 2131032 A1 | 12/2009 |
| WO | 2005085650 A1 | 9/2005 |

* cited by examiner

*Primary Examiner* — Stephen K Cronin
*Assistant Examiner* — Charles Brauch
(74) *Attorney, Agent, or Firm* — Foley & Lardner LLP

(57) ABSTRACT

An engine system that includes a timing drive cavity defined by at least one of an engine block, front cover, and timing drive cover, a timing drive positioned within the timing drive cavity, and a fluid pump assembly. The fluid pump assembly includes an impeller housing, a fluid inlet port coupled to the impeller housing, and a fluid outlet port coupled to the impeller housing. At least one of the fluid inlet and fluid outlet ports is positioned at least partially within the timing drive cavity.

21 Claims, 5 Drawing Sheets

FLUID PUMP ASSEMBLY

FIELD

The present disclosure relates to internal combustion engines, and more particularly to fluid pumps that pump fluid throughout an internal combustion engine.

BACKGROUND

Fluid pumps are used within an internal combustion engine system to pump fluid throughout the system. One such fluid pump is the coolant pump. Coolant pumps are often referred to as water pumps because a mix of glycol and water is a common coolant. Commonly, the water pump forms part of an engine cooling system that reduces the temperature of various components of the engine by transferring heat from the components into coolant being pumped through the system by the water pump.

Water pumps are often combined with the fan drive pulley to reduce accessory belt complexity, cost, and bearing power consumption. Some conventional fan-centered water pumps are integrated into the block or front cover of an internal combustion engine. The engine block, or front cover, and the water pump housing define an impeller housing within which an impeller spins. Adjacent the impeller housing is a volute. As the impeller spins within the impeller housing, the impeller causes coolant received from an inlet at the impeller's axial center to enter the impeller and impeller housing, and pass through to the volute at an increased pressure. The increased pressure of the coolant drives the water through the engine cooling system to facilitate heat transfer with the heated components of the engine. The heat transfer from various components into the coolant raises its temperature. The higher temperature water passes through a heat exchanger such as an air-to-coolant radiator prior to returning to the pump inlet. The pressure of the coolant decreases as it passes through the engine cooling system, including a radiator, and reenters the water pump through the inlet at a relatively low pressure and temperature.

The impeller housing of certain conventional water pumps is formed by coupling together two halves of the housing. Typically, one half of the impeller housing also includes a portion (e.g., half) of the volute, and the other half of the impeller housing includes the other portion (e.g., half) of the volute. Such a split configuration of the volute introduces several disadvantages, such as high manufacturing and component costs, seal complexities for suction-side sealing, volute sealing, fan hub structural integrity, length, part-to-part misalignment, etc. Further, conventional fan-centered water pumps, including the inlets and outlets, are situated on one side of the timing drive cavity, which may house a belt system, gear system, and/or chain system. Such a configuration does not utilize the space of the timing drive cavity. Rather, these conventional water pump configurations only add to the length of the engine. Moreover, for such conventional water pump configurations utilizing a timing belt, the length added to the engine is particularly exacerbating, as timing belts are already wider than gears and chains.

Additionally, conventional fan-centered water pumps require a fluid seal between the water pump and the fan shaft and bearings. The inlet of typical water pumps is situated adjacent the fan shaft and bearings. Accordingly, the fluid seal is positioned on the inlet or suction side of the water pump, which can negatively affect the performance of the fluid seal.

SUMMARY

The subject matter of the present application has been developed in response to the present state of the art, and in particular, in response to the problems and needs in art associated with fluid pumps for internal combustion engines that have not yet been fully solved by currently available fluid pumps. Accordingly, the subject matter of the present application has been developed to provide a fluid pump, and associated apparatus, systems, and methods, that overcomes many of the shortcomings of the prior art. For example, in some embodiments, as opposed to prior art systems, the fluid pump of the present disclosure integrates the entire volute of the pump into a single portion or cast section of the impeller housing. Also, the demands of modern internal combustion engines require wider timing drives (e.g., timing belts, chains, etc.) and associated timing drive cavities. Because conventional water pump systems are situated on one side of the timing belt cavity or the other, the increase in the width of the timing drive cavities only increases the overall length of the engine. However, in certain embodiments, the fluid pump of the present disclosure positions portions (e.g., inlet and outlet tubes) of the fluid pump within the timing drive cavity to minimize the effect of the extra width of the timing drive cavity on the overall length of the engine. Also, in some embodiments, the fluid pump of the present disclosure positions the fluid seal on the high pressure side of the fluid pump, as opposed to the low pressure or suction side of the fluid pump as with prior art configurations.

According to one embodiment, an engine system includes a timing drive cavity defined by at least one of an engine block, front cover, and timing drive housing. The engine system also includes a timing drive positioned within the timing drive cavity, and the engine system includes a fluid pump assembly. The fluid pump assembly includes an impeller housing, a fluid inlet port coupled to the impeller housing, and a fluid outlet port coupled to the impeller housing. At least one of the fluid inlet and fluid outlet ports is positioned at least partially within the timing drive cavity. The engine system may also include an engine block cover (which can be or include a timing drive housing cover) removably attached to the engine block. The engine block cover encloses the timing drive cavity, and the impeller housing can form a monolithic one-piece construction with the engine block cover.

In some implementations of the engine system, the fluid inlet port extends through the timing drive cavity. In yet some implementations of the engine system, the fluid outlet port extends through the timing drive cavity. According to some implementations of the engine system, both the fluid outlet and inlet ports extend through the timing drive cavity. The fluid inlet port and fluid outlet port may each include a tubular extension.

According to certain implementations of the engine system, the timing drive is positioned between first and second opposing sides of the timing drive cavity. The impeller housing is positioned at the first side of the timing drive cavity. At least one of an inlet of the fluid inlet port and an outlet of the fluid outlet port is positioned at the second side of the timing drive cavity. The engine system may also include an engine fan assembly positioned adjacent the first side of the timing drive cavity. The fluid pump assembly includes an impeller positioned within the impeller housing, and the impeller is driven by the same accessory belt pulley as the engine fan assembly. A fluid seal can be positioned between the engine fan assembly and the impeller housing. At least one of an outlet of the fluid inlet port and an inlet of the fluid outlet port is positioned at the first side of the timing drive cavity.

In some implementations of the engine system, the engine block includes at least one low pressure fluid conduit fluidly coupled with the fluid inlet port, and at least one high pressure fluid conduit fluidly coupled with the fluid outlet port.

According to certain implementations, the impeller housing, which includes a volute, has an inlet and an outlet. The fluid inlet port is fluidly coupled with the inlet of the volute and the fluid outlet port is fluidly coupled with the outlet of the volute. At least one of the fluid inlet and fluid outlet ports that is positioned at least partially within the timing drive cavity can be longer than a width of the timing drive. In certain implementations, the fluid inlet port can include flow straightening features. According to yet some implementations, the engine system may include a fluid seal between the timing drive cavity and the fluid pump, where the fluid seal is positioned on a high pressure side of the fluid pump.

According to another embodiment, a fluid pump assembly for an internal combustion engine includes a one-piece impeller housing that has a sealed end and an open end. The impeller housing defines a portion of an impeller cavity. The impeller housing further defines an entire volute communicable in fluid receiving communication with the impeller cavity. Additionally, the fluid pump assembly includes a cap that is sealingly attached to the open end of the impeller housing. The impeller cavity is defined between the sealed end and the cap. Also, the fluid pump assembly includes an impeller positioned within the impeller cavity. The impeller is rotatable within the impeller cavity. The impeller housing can include an annular flange, and the annular flange can define the open end such that the cap can be seated within the annular flange.

In some implementations of the assembly, the cap also includes a fluid inlet that is communicable in fluid receiving communication with a fluid source and fluid providing communication with the impeller cavity. The cap and fluid inlet form a one-piece monolithic construction. In yet some implementations, the impeller housing further includes a fluid outlet that is communicable in fluid receiving communication with the volute. The impeller housing and fluid outlet can form a once-piece monolithic construction. The impeller can be a shrouded impeller.

According to certain implementations of the assembly, the impeller is rotatable about a central axis. The cap can further include a fluid inlet extension tube that extends parallel to and coaxial with the central axis. The impeller housing can further include a fluid outlet extension tube that extends parallel to, but is offset from, the central axis.

According to yet another embodiment, a water pump for an internal combustion engine includes an impeller housing that has an entire volute circumscribing an impeller cavity. The volute is coupled to a high pressure water outlet. Further, the impeller housing is formed of a first one-piece monolithic construction. The water pump also includes a housing cap that is sealingly attached to the impeller housing and encloses the impeller cavity. The housing cap includes a low pressure water inlet. The housing cap is formed of a second one-piece monolithic construction separate from the first one-piece monolithic construction of the impeller housing.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which.

DETAILED DESCRIPTION

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

Figure 1:
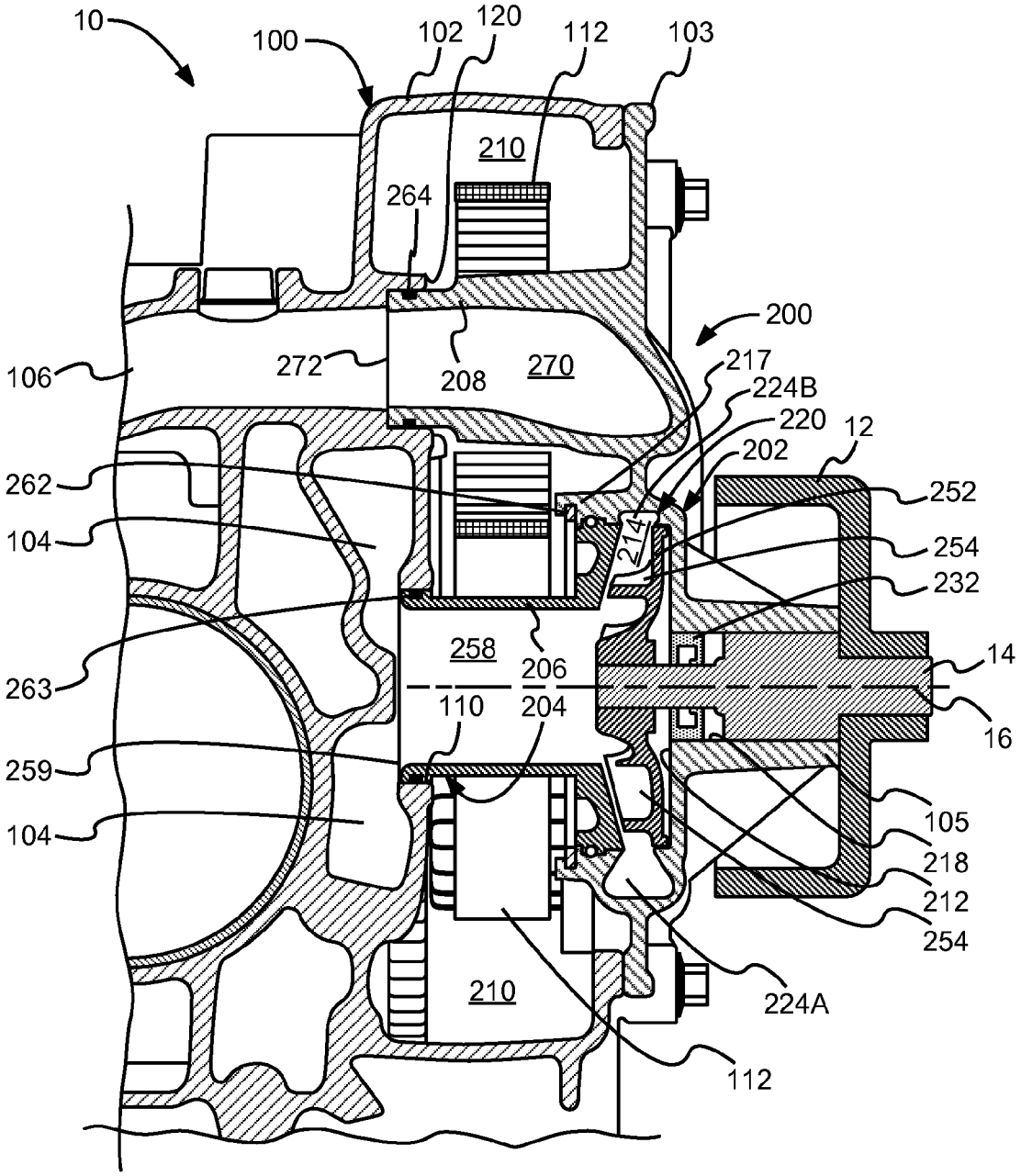
FIG. 1 is a cross-sectional side view of an engine block with a fluid pump according to one embodiment.

Referring to FIG. 1, according to one embodiment, an internal combustion engine 10 includes an engine block 100. The internal combustion engine 10 can be a compression-ignited internal combustion engine, such as a diesel-fueled engine, or a spark-ignited internal combustion engine, such as a gasoline-fueled engine. Like most conventional engines, the internal combustion engine 10 includes an engine block 100 and an engine cooling fan drive pulley 12 rotatably coupled to the engine assembly via a spindle or shaft 14. The fan clutch and fan assembly are not shown for convenience in showing other aspects of the subject matter of the present disclosure. The drive pulley 12 of the cooling fan is co-rotatably coupled to the shaft 14, which is driven by an accessory drive belt (not shown). In other words, the accessory drive belt rotates the drive pulley 12 of the cooling fan, which rotates the shaft 14. The shaft 14 is rotatably coupled to a cover 103 of the engine block via a shaft receptacle 105. Although not shown, one or more bearings can be positioned between the shaft 14 and the receptacle 105 to facilitate secure and low-friction rotation of the shaft relative to the receptacle. As shown, the shaft 14 rotates about a central axis 16 of the shaft.

The cover 103 is removably coupled to a front portion 102 of the engine block 100. The front portion 102 may be formed as part of the cylinder block as shown or may be comprised of an additional housing (not shown). The front portion 102 includes various cavities, conduits, and lines formed into the front portion. For example, the front portion 102 includes a fluid inlet line 104 that receives fluid from a sub-system of the engine 10. In one implementation, the fluid inlet line 104 is a low pressure water inlet line that is fluidly coupled to a cooling sub-system of the engine 10. In other words, the water inlet line 104 receives low pressure water returning from a cycle through the cooling system. Similarly, the front portion 102 includes a fluid outlet line 106 that provides fluid to a sub-system of the engine 10. In one implementation, the fluid outlet line 106 is a high pressure water outlet line that is fluidly coupled to the cooling sub-system of the engine 10. In other words, the water outlet line 106 provides high pressure water to the cooling system to initiate a cooling cycle. The fluid inlet and outlet lines 104, 106 include openings or receptacles 110, 120, respectively, configured to receive corresponding extensions of the cover 103. Alternatively, in some embodiments, the fluid inlet and outlet lines 104, 106 include respective extensions and the cover 103 includes corresponding openings or receptacles.

Figure 2:
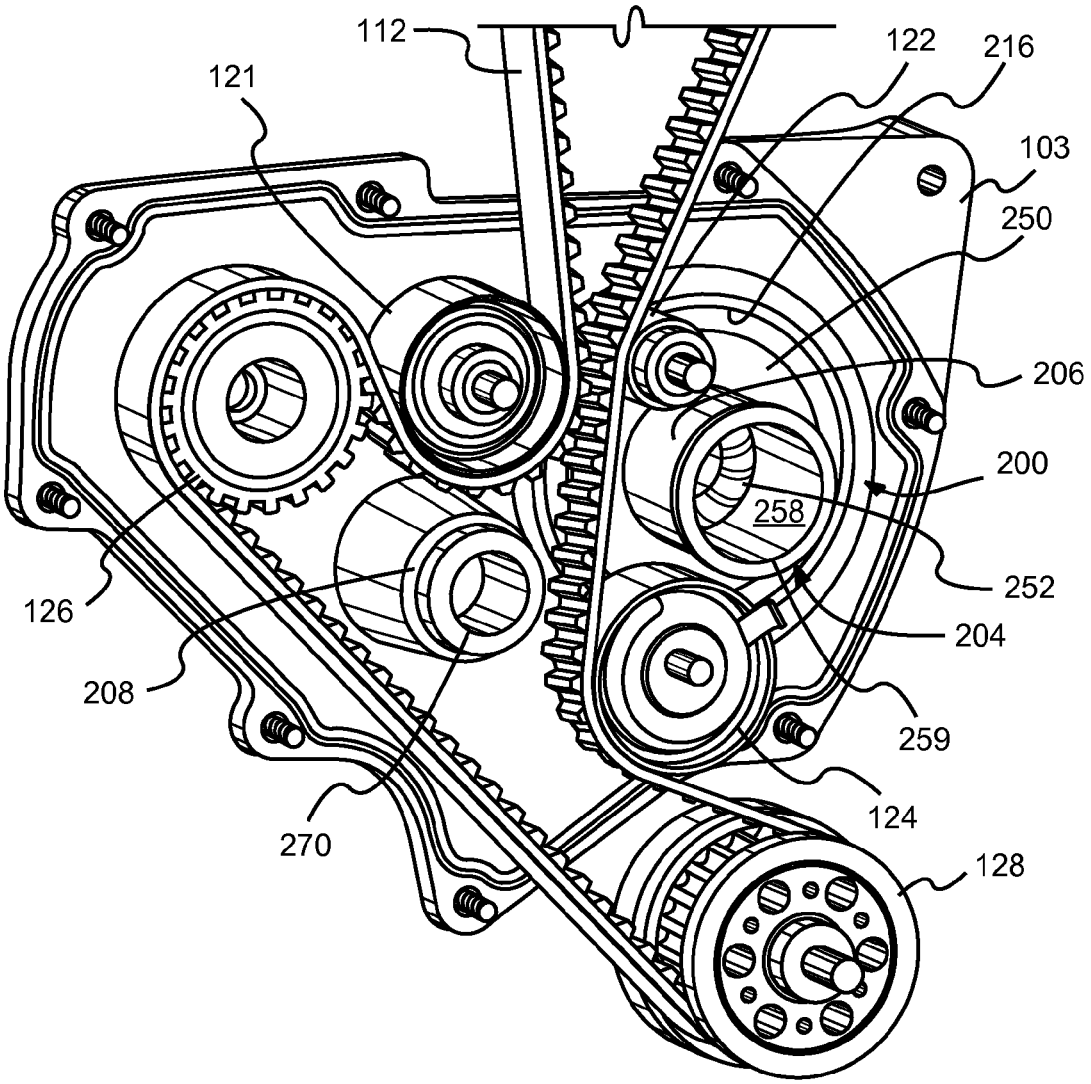
FIG. 2 is a perspective view of a fluid pump according to one embodiment shown with the engine block removed.

The front portion 102 also includes a portion of a timing drive cavity 210. The timing drive cavity 210 extends a width corresponding to the width of a timing drive 112 associated with operation of the engine 10. The timing drive can be any of various types of drives, such as belts, chains, and gears. As shown in FIG. 1, the width of the timing drive cavity 210 extends from a left side of the cavity defined by the front portion 102 to a right side of the cavity defined by the cover 103. In other words, the width of the timing drive cavity 210 as defined herein is the distance between sidewalls of the cavity in a direction parallel to the central axis 16 of the shaft 14. Additionally, the width of the timing drive cavity 210 must be large enough to accommodate the widths of various timing drive support components, such as idlers and tensioners, positioned within the timing drive cavity as shown in FIG. 2. For example, referring to FIG. 2, the timing belt 112 is coupled in sprocket meshing engagement with first and second sprockets 126, 128. The first sprocket 126 is driven by the timing belt 112, and can be coupled to a fuel pump of the engine 10. The second sprocket 128 can drive the timing belt 112, which is driven by a crankshaft of the engine 10. The timing belt 112 is also rotatably coupled with first, second, and third belts pulleys and/or tensioners 121, 122, 124 that maintain the tautness and position of the timing belt 112 within the timing drive cavity 210. In the illustrated embodiments, the height and length of the timing drive cavity 210 are minimally greater than the width of the timing drive.

The engine block 100 supports a fluid pump 200, which in the illustrated embodiment, is a water pump. The fluid pump 200 is integrated into the engine block 100 and spans the timing drive cavity 210 to conserve space. As shown in FIG. 1, the fluid pump 200 includes an impeller housing 202, a housing cap 204 coupled to the impeller housing, a fluid inlet extension tube 206 forming part of the cap, and a fluid outlet extension tube 208. The fluid inlet extension tube 206 can form a fluid inlet port or conduit and the fluid outlet extension tube 208 can form a fluid outlet port or conduit.

The impeller housing 202 defines an impeller cavity 214, which is sized and shaped to house an impeller 252. Generally, the impeller 252 is substantially disk-shaped with a plurality of blades 254 that extend transversely from the disk portion of the impeller. The height of the blades 254 away from the disk portion varies radially along the disk. In one implementation, the height of the blades is higher near a radially inner portion of the disk and decreases towards a radially outer portion of the disk. Accordingly, to accommodate the shape of the impeller 252, the impeller cavity 214 may have a conical frustum shape with a substantially trapezoidal-shaped cross-section. The impeller cavity 214 extends in a direction parallel to the central axis 16 from a closed end 212 to an open end 216 (see, e.g., FIG. 3). The closed end 212 is considered closed because a sealing member 232 seals a shaft opening 218 in the closed end. The sealing member 232 is positioned within and sealingly engages the shaft opening 218 to prevent fluid from flowing through the shaft opening 218. The sealing member 232 also sealingly engages the shaft 14 while allowing the shaft to freely rotate relative to the impeller housing 201. In some implementations, the sealing member 232 is a rotary seal, which conventionally weeps a small volume of coolant into the cavity between the shaft bearing and seal. The details of a corresponding weep chamber are not shown for clarity in illustrating other components of the assembly. The inner end of the shaft 14 is co-rotatably coupled to the impeller 252. In this manner, the shaft 14 supports the impeller 252 within the impeller cavity 214 and drives rotation of the impeller within the cavity. The open end 216 can be defined by a flange portion 217 that also defines a receptacle for receiving the housing cap 204 as will be described in more detail below.

The impeller housing 202 also defines a volute 220 that is open to the impeller cavity 214. More specifically, the volute 220 is defined about and is open to the radially outer periphery (e.g., circumference) of the impeller cavity 214. The volute 220 is a substantially spiral-shaped conduit having an increasing cross-sectional size in a fluid flow direction through the conduit.

In the illustrated embodiment, the impeller housing 202 and volute 220 are formed as a one-piece monolithic construction with the cover 103. In other words, the cover 103, impeller housing 202, and the entire volute 220 are formed as a single unitary piece. In some implementations, the cover 103, including the impeller housing 202 and volute 220 are formed using a manufacturing technique, such as casting, forging, or molding. In one implementation, the cover 103, impeller housing 202, and volute 220 are cast as a single piece of metal, such as aluminum or an aluminum alloy. In other words, in some implementations, the entire volute 220 is cast as a single piece with the cover because the entire conduit of the volute is formed in the cover. In other words, no portion of the conduit of the volute 220 is formed by secondary components or pieces, such as the cap 204.

Figure 3:
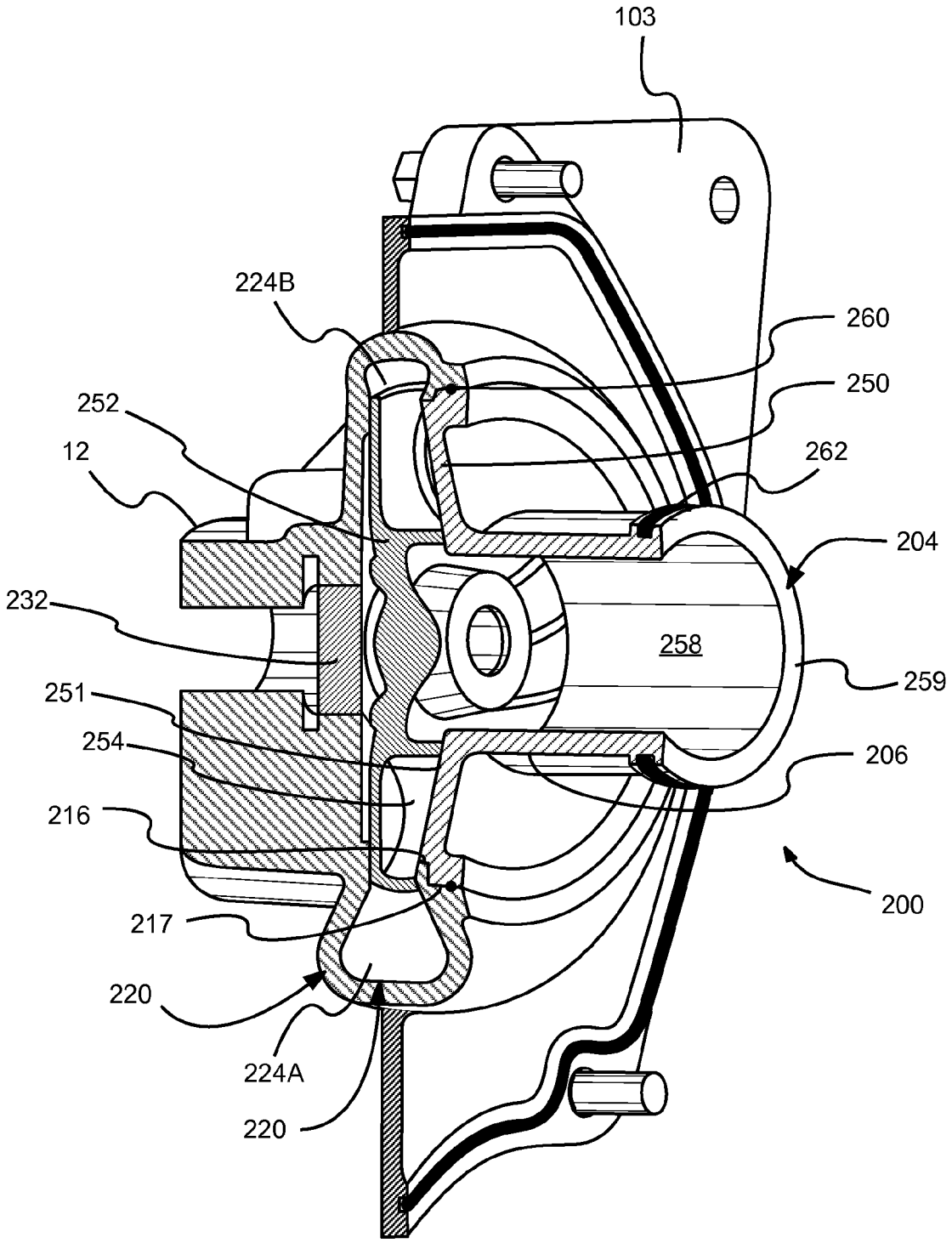
FIG. 3 is a cross-sectional side view of a fluid pump according to one embodiment.
Figure 4:
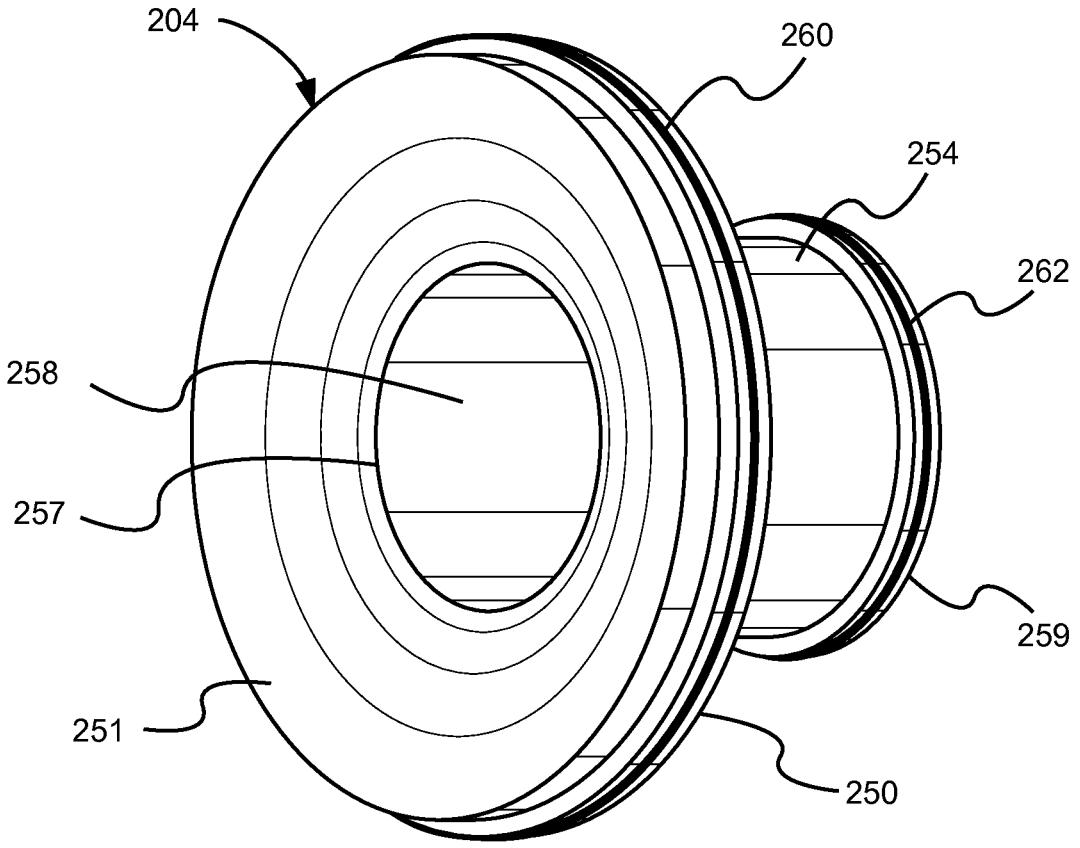
FIG. 4 is a perspective view of a cap for sealing an open end of an impeller housing of a fluid pump according to one embodiment.

However, the cap 204 is used to at least partially seal the open end 216 of the impeller cavity 214 to at least partially enclose the impeller 252 within the cavity. The cap 204 includes a cavity sealing portion 250 and a fluid inlet extension tube 206 (see, e.g., FIG. 3). The cavity sealing portion 250 sealingly engages the flange portion 217 of the impeller housing 202, and at least partially covers the impeller cavity 214. The cavity sealing portion 250 has a substantially circular-shaped outer periphery that corresponds with the shape of the receptacle defined by the flange portion 217. In this manner, a radially outer portion of the cavity sealing portion 250 can be seated within the receptacle to couple the cap 204 to the impeller housing 202 to at least partially seal the impeller cavity 214. As shown in FIGS. 3 and 4, the cavity sealing portion 250 defines a cavity surface 251 that, when the radially outer portion of the cavity sealing portion 250 is seated within the flange portion 217, faces the impeller 252 and defines a boundary of the impeller cavity 214 to enclose the impeller 252 within the cavity. In one implementation, the cavity sealing portion 250 includes a sealing member, such as an o-ring 260, at its radially outer portion that engages the inner surface of the flange portion 217 to create a seal between the flange portion and the cavity sealing portion 250 (see, e.g., FIG. 4). In other implementations, an outer peripheral surface of the cavity sealing portion 250 is press-fit against the inner surface of the flange portion 217 to create the seal. The cap 204 can be secured in seated engagement with the flange portion 217 via a fastener, such as a circle clip 262 engaged with an annular recess formed in the flange portion (see, e.g., FIG. 1), or other coupling technique, such as a press-fit connection or other fastener connection.

Figure 5:
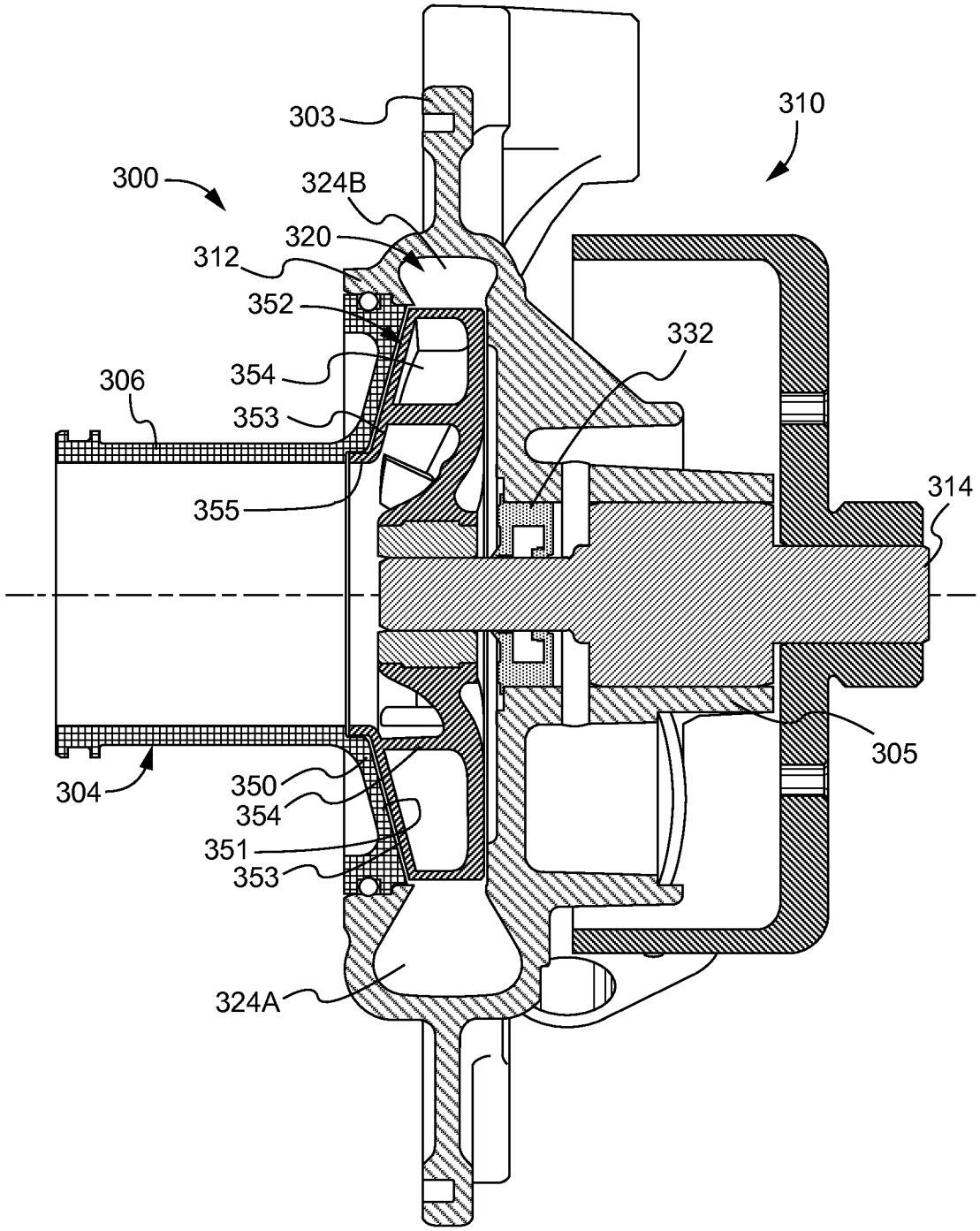
FIG. 5 is a cross-sectional side view of a fluid pump with a shrouded impeller according to one embodiment.

As shown in FIG. 5 with features of the engine 310 removed for convenience, in some embodiments, the impeller of the fluid pump is a shrouded impeller. Some features of the pump assembly 300 of the engine 310 are similar to the pump assembly 200 of the engine 10, with like numbers referring to like features. However, the impeller 352 of the pump assembly 200 is a shrouded impeller. More specifically, an inlet side of the vanes 354 of the impeller 352 is covered with a shroud 353 that is coupled to the vanes and co-rotates with the vanes. The shroud 353 of the impeller 352 inlet defines an inlet 355 that can be configured to be inserted at least partially into or at least partially seated within the fluid inlet extension tube 306 of the housing cap 304. In this manner, the fluid inlet extension tube 306 of the housing cap 304need only maintain close radial clearance between the fluid inlet extension tube 306 and the inlet 355 of the shrouded impeller 352 for proper operation of the impeller 352. Accordingly, close axial clearance and control between the impeller 352 and cavity sealing portion 350 of the housing cap 304 that would be required for proper operation of an un-shrouded impeller is not necessary. In view of the use of a shrouded impeller 352, in certain embodiments, the cap 304 may not include such a pronounced cavity sealing portion 350 and the flange 317 may extend radially inwardly to sealingly engage the extension tube 206 directly. In other words, because the impeller 352 is shrouded, the cap 304 need not be configured to envelope the impeller. In this manner, the housing 302 as defined herein can be any type of housing defining a cavity within which all or a portion of an impeller is positioned.

The fluid inlet extension tube 206 extends substantially transversely away from the cavity sealing portion 250 from a first open end 257 to a second open end 259. The extension tube 206 defines a fluid inlet conduit 258 that extends between the first and second open ends 257, 259. When the cap 204 properly seated within the flange portion 217, the fluid inlet extension tube 206, and fluid inlet conduit 258 defined thereby, are substantially coaxial with the central axis 16 of the shaft 14. Accordingly, fluid flowing through the fluid inlet conduit 258 flows the length of the conduit in a straight path, which facilitates non-turbulent fluid flow into the impeller cavity 214. Although not shown, additional flow straightening features, such as vanes, may be deployed within the inlet conduit 258 to further promote non-turbulent flow. Such arrangements avoid the negative effects of turbulent flow into the impeller cavity caused by bent tubes leading into the cavity as is associated with some conventional fluid pumps. Moreover, when the cap 204 is properly seated within the flange portion 217, the fluid inlet extension tube 206 spans the width of the timing drive cavity 210 (see, e.g., FIG. 2).

The second open end 259 is received within, and sealingly engaged with, the receptacle 110 formed in the front portion 102 of the engine block 100 (e.g., via an o-ring 263). Additional sealing strategies may be deployed in lieu of the o-ring 263, such as press-in-place face seals or form-in-place radial seals. In this manner, the second open end 259 is fluidly coupled with the fluid inlet lines 104 formed in the front portion 102. Accordingly, fluid in the fluid inlet lines 104 may flow into the fluid inlet conduit 258 of the extension tube 206 through the second open end 259 and flow into the impeller cavity 214 via the first open end, which is open to the impeller cavity. Fluid flowing into the impeller cavity 214 from the fluid inlet extension tube 206 enters the inlet section 224A of the volute 220 by virtue of the rotational direction of the impeller 252 and configuration of the blades 254 of the impeller. In other words, when fluid is present in the fluid inlet conduit 258 and adjacent the impeller 252, rotation of the impeller draws or sucks fluid from fluid inlet lines 104, through the extension tube 206, and into the inlet section 224B of the volute 220.

After passing through the conduit of the volute 220, the pressurized fluid enters into a fluid outlet conduit 270 via the outlet section 224A of the volute. The fluid outlet conduit 270 is formed in the cover 103 of the engine block 100 and defined by the fluid outlet extension tube 208. The fluid outlet extension tube 208 extends from a first open end that is open to the outlet section 224A of the volute to a second open end 272. Accordingly, the fluid outlet conduit 270 extends between the first open end and second open end 272 of the fluid outlet extension tube 208. The second open end 272 is received within and sealingly engaged with the receptacle 120 formed in the front portion 102 of the engine block 100 (e.g., via an o-ring 264). Again, alternative seals strategies may be deployed to facilitate the sealing engagement between the fluid outlet extension tube 208 and the receptacle 120. In this manner, the second open end 272 is fluidly coupled with the fluid outlet line 106 formed in the front portion 102. Accordingly, fluid exiting the outlet section 224B of the volute 220 may flow into the fluid outlet line 106 through the fluid outlet conduit 270 of the fluid outlet extension tube 208. As shown, when the cover 103 is properly coupled to the front portion 102, and the second open end 272 is sealingly engaged with the receptacle 220, the fluid outlet extension tube 208 spans the width of the timing drive cavity 210.

As shown in FIG. 2, the fluid inlet and outlet extension tubes 206, 208 protrude from the cover 103 into the timing drive cavity 210 of the engine block 100, but do not obstruct or interfere with the operation of the timing drive 112. In other words, the extension tubes 206, 208 are positioned on the cover 103 at locations away from the pulleys and/or tensioners 121, 122, 124, and path of the timing drive 112. Because the fluid pump 200 positions the extension tubes 206, 208 within the timing drive cavity 210, the inlet and outlet of the fluid pump do not add to the overall length of the engine block 100. Therefore, as opposed to directing inlet and outlet tubes around the timing drive as with conventional fluid pumps cavity, the present fluid pump 200 reduces the effect of widening the timing drive cavity on the overall length of the engine block 100 reduced.

In operation, rotation of the shaft 14 by the accessory belt drives the rotation of the impeller 252 within the impeller cavity 214. The impeller 252 is rotated by the shaft 14 in a fluid flow direction. As the impeller 252 rotates within the impeller cavity 214 in the fluid flow direction, the blades 254 of the impeller force fluid into the inlet section 224A of the volute 220 and through the volute in the fluid flow direction. The displacement of the fluid into the volute 220 acts to draw or pull fluid present in the fluid inlet line 104 and fluid inlet conduit 258 through the fluid inlet conduit 258. Accordingly, the open end 216 of the impeller housing 202 or inlet side of the pump 200 is considered a suction or low pressure side. As the fluid flows through the spiral-shaped conduit of the volute 220, the increasing cross-sectional area of the conduit acts to collect the fluid from the impeller and translate the radial velocity of the fluid into tangential velocity and pressure. The fluid at an increased pressure then exits the volute through the outlet section 224B and into the fluid outlet conduit 270 of the outlet extension tube 208. From the fluid outlet conduit 270, the pressurized fluid flows into the fluid outlet line 106 and into the cooling sub-system(s) of the engine. Because the pressurized fluid has a higher pressure upon exiting the volute compared to when the fluid entered the volute, the closed end 212 of the impeller housing 202 or outlet side of the pump 200 is considered a high pressure side. Because the sealing member 232 is positioned on the high pressure side of the pump 200, as opposed to the low pressure side, the performance of the sealing member is enhanced.

In the above description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

Reference throughout this specification to features, advantages, or similar language does not imply that all of the features and advantages that may be realized with the subject matter of the present disclosure should be or are in any single embodiment or implementation of the subject matter. Rather, language referring to the features and advantages is understood to mean that a specific feature, advantage, or characteristic described in connection with an embodiment is included in at least one embodiment of the subject matter of the present disclosure. Discussion of the features and advantages, and similar language, throughout this specification may, but do not necessarily, refer to the same embodiment or implementation.

The present subject matter may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An engine system, comprising:

a timing drive cavity defined by at least one of an engine block, front cover, and timing drive housing;

a timing drive comprising at least two rotatable timing drive components positioned within the timing drive cavity to share a cross-sectional plane perpendicular to an axis of rotation of each of the at least two rotatable timing drive components; and a fluid pump assembly comprising an impeller housing, a fluid inlet port coupled to the impeller housing, and a fluid outlet port coupled to the impeller housing, wherein at least one of the fluid inlet and fluid outlet ports is positioned at least partially within the timing drive cavity and shares the cross-sectional plane, and wherein the cross-sectional plane is perpendicular to the at least one of the fluid inlet and the fluid outlet ports.

2. The engine system of claim 1, wherein the fluid inlet port extends through the timing drive cavity.

3. The engine system of claim 1, wherein the fluid outlet port extends through the timing drive cavity.

4. The engine system of claim 1, wherein both the fluid outlet and inlet ports extend through the timing drive cavity.

5. The engine system of claim 1, wherein the timing drive is positioned between first and second opposing sides of the timing drive cavity, wherein the impeller housing is positioned at the first side of the timing drive cavity, and at least one of an inlet of the fluid inlet port and an outlet of the fluid outlet port is positioned at the second side of the timing drive cavity.

6. The engine system of claim 5, further comprising an engine fan assembly positioned adjacent the first side of the timing drive cavity, the engine fan assembly being driven by an accessory belt pulley, wherein the fluid pump assembly comprises an impeller positioned within the impeller housing, and wherein the impeller also is driven by the accessory belt pulley.

7. The engine system of claim 6, further comprising a fluid seal between the engine fan assembly and the impeller housing.

8. The engine system of claim 5, wherein at least one of an outlet of the fluid inlet port and an inlet of the fluid outlet port is positioned at the first side of the timing drive cavity.

9. The engine system of claim 1, wherein the fluid inlet port and fluid outlet port each comprises a tubular extension.

10. The engine system of claim 1, wherein the at least one of the engine block, front cover, and timing drive housing comprises at least one low pressure fluid conduit fluidly coupled with the fluid inlet port, and the at least one of the engine block, front cover, and timing drive housing comprises at least one high pressure fluid conduit fluidly coupled with the fluid outlet port.

11. The engine system of claim 1, wherein the impeller housing comprises a volute having an inlet and an outlet, the fluid inlet port being fluidly coupled with the inlet of the volute and the fluid outlet port being fluidly coupled with the outlet of the volute.

12. The engine system of claim 1, wherein the at least one of the fluid inlet and fluid outlet ports that is positioned at least partially within the timing drive cavity is longer than a width of the timing drive.

13. The engine system of claim 1, further comprising an engine block and an engine block cover removably attached to the engine block, wherein the engine block cover encloses the timing drive cavity, and wherein the impeller housing forms a monolithic one-piece construction with the engine block cover.

14. The engine system of claim 1, wherein the fluid inlet port comprises flow straightening features.

15. The engine system of claim 1, further comprising a fluid seal between the timing drive cavity and the fluid pump, the fluid seal being positioned on a high pressure side of the fluid pump.

16. A fluid pump assembly for an internal combustion engine, comprising:

a one-piece impeller housing comprising a sealed end and an open end, the impeller housing defining a portion of an impeller cavity, and the impeller housing further defining an entire volute communicable in fluid receiving communication with the impeller cavity;

a cap sealingly attached to the open end of the impeller housing, the impeller cavity being defined between the sealed end and the cap, the cap comprising a fluid inlet extension tube in fluid receiving communication with a fluid source and in fluid providing communication with the volute; and an impeller positioned within the impeller cavity, the impeller being rotatable within the impeller cavity about a central axis, wherein the fluid inlet extension tube extends along an axis that is parallel to the central axis and shares a cross-sectional plane with at least two timing drive components, the cross-sectional plane perpendicular to the central axis.

17. The fluid pump assembly of claim 16, wherein the impeller housing further comprises a fluid outlet extension tube in fluid receiving communication with the volute that extends parallel to the central axis.

18. The fluid pump assembly of claim 16, wherein the impeller housing comprises an annular flange, the annular flange defining the open end, and wherein the cap is seated within the annular flange.

19. The fluid pump assembly of claim 16, wherein the impeller is a shrouded impeller.

20. A water pump for an internal combustion engine, comprising:

an impeller housing comprising an entire volute defining a central axis and circumscribing an impeller cavity, the volute being coupled to a high pressure water outlet tube, wherein the impeller housing is formed of a first one-piece monolithic construction; and a housing cap sealingly attached to the impeller housing and enclosing the impeller cavity, the housing cap comprising a low pressure water inlet tube, wherein the housing cap is formed of a second one-piece monolithic construction separate from the first one-piece monolithic construction of the impeller housing, wherein at least one of the water outlet tube and the water inlet tube is disposed along an axis that is parallel to the central axis and shares a cross-sectional plane with at least two timing drive components, the cross-sectional plane perpendicular to the central axis.

21. The fluid pump assembly of claim 16, wherein the fluid inlet extension tube is coaxial with the central axis.

* * * * *